US006685388B2

(12) United States Patent
Webster et al.

(10) Patent No.: US 6,685,388 B2
(45) Date of Patent: Feb. 3, 2004

(54) MULTI-PURPOSE MAT

(75) Inventors: Steve L Webster, Vicksburg, MS (US); Carroll J. Smith, Vicksburg, MS (US)

(73) Assignees: The United States of America as represented by the Secretary of the Army, Washington, DC (US); Humphreys Engineer Center, Alexander, VA (US)

( * ) Notice: Subject to any disclaimer, the term of this patent is extended or adjusted under 35 U.S.C. 154(b) by 0 days.

(21) Appl. No.: 10/211,515

(22) Filed: Aug. 5, 2002

(65) Prior Publication Data

US 2002/0192024 A1 Dec. 19, 2002

(51) Int. Cl.[7] ..... E01C 5/00; F16D 1/00
(52) U.S. Cl. ..... 404/35; 403/408.1
(58) Field of Search ..... 404/34, 35, 41; 403/315, 408.1

(56) References Cited

U.S. PATENT DOCUMENTS

| | | | | | |
|---|---|---|---|---|---|
| 726,506 | A | * | 4/1903 | Capen | 52/591.4 |
| 2,653,525 | A | | 9/1953 | McGuire | |
| 3,964,221 | A | * | 6/1976 | Berquist | 52/177 |
| 4,289,420 | A | * | 9/1981 | Davis et al. | 404/35 |
| 4,404,244 | A | | 9/1983 | Springston | |
| 4,600,337 | A | | 7/1986 | Sarver | |
| 4,605,337 | A | | 8/1986 | Springston et al. | |
| 4,629,358 | A | | 12/1986 | Springston et al. | |
| 4,746,243 | A | | 5/1988 | Perry | |
| 4,963,055 | A | * | 10/1990 | Sims, Jr. | 404/41 |
| 5,076,748 | A | * | 12/1991 | Waterfield et al. | 411/551 |
| 5,653,551 | A | * | 8/1997 | Seaux | 404/35 |
| 5,776,582 | A | | 7/1998 | Needham | |
| 5,888,612 | A | | 3/1999 | Needham et al. | |
| 6,007,271 | A | | 12/1999 | Cole et al. | |
| 6,511,257 | B1 | * | 1/2003 | Seaux et al. | 404/34 |

OTHER PUBLICATIONS

Santoni, R.L. et al., Expedient Road Construction Over Soft Soils; U.S. Army Corps of Engineers, Engineer Research and Development Center, Vicksburg, MS, USA, May 2001, 96 pp.

* cited by examiner

*Primary Examiner*—Gary S. Hartmann
(74) *Attorney, Agent, or Firm*—Earl H. Baugher, Jr.

(57) ABSTRACT

Multipurpose panels having L-shaped tabs are interconnected using durable connectors to form a multipurpose mat that facilitates mobility over otherwise unstable terrain. In one embodiment, four-sided panels are fabricated from laminations of fiberglass-reinforced plastic (FRP) with radiused rectangular holes machined in each of two adjacent edges and a recessed L-shaped tab formed along opposing adjacent edges. The connectors are fabricated from corrosion resistant metal and assembled to precise specifications prior to insertion in the rectangular holes machined in pre-specified types of panel. Top and bottom plates of durable connectors are fabricated from 6061-T6 aluminum stock. A threaded bolt used to tie the plates together, to which a liquid threadlocker is applied, is fabricated from a steel alloy suitable for use with aluminum. Two specially fabricated tools, a spacer guide and an alignment tool, may be used to optimize installation. These also may be fabricated from 6061-T6 aluminum stock.

23 Claims, 8 Drawing Sheets

MULTI-PURPOSE MAT

STATEMENT OF GOVERNMENT INTEREST

Under paragraph 1(a) of Executive Order 10096, the conditions under which this invention was made, entitle the Government of the United States, as represented by the Secretary of the Army, to an undivided interest in any patent granted thereon by the United States. This invention was made in part under United State Army Construction Engineering Research Laboratory Contracts numbered DACA88-93-C-0008 and DACA88-94-C-0024. This and related patents are available for licensing. Please contact Bea Shahin at 217 373-7234 or Phillip Stewart at 601 634-4113.

FIELD OF THE INVENTION

The field is lightweight panels, connectors and tools used to construct mats that enable or enhance mobility across unstable terrain.

BACKGROUND

It is desirable to move heavy vehicles over unstable terrain during various events. These events may include environmental remediation, military maneuvers, or scientific exploration of environmentally fragile areas. Mat panels have been used successfully for applications that are similar to this, such as expedient aircraft runway repair. Mat panels of a preferred embodiment of this invention use fiberglass-reinforced plastic (FRP) material similar to that of a mat developed by the U.S. military for airfield pavement repair. Three U.S. patents resulted from development work on these military panels.

U.S. Pat. No. 4,404,244, System for Rapid Repair of Damaged Airfield Runways, to Springston, Sep. 13, 1983, describes a membrane of FRP prefabricated from several chopped fiberglass matting layers chemically bonded to woven fiberglass roving and impregnated with a polyester resin to yield a panel of a typical thickness of ⅜ in. The anchoring system comprised special bushings fitted to holes along the edges of the panels for use with torque set rock bolts anchored to the edges of undamaged runway.

U.S. Pat. No. 4,605,337, Expedient Runway Surfacing with Post Tensioning System for Expeditionary Airfields, to Springston et al., Aug. 12, 1986, describes a system for building a runway with FRP panels that also uses a self-contained hydraulic tensioning system and a deadman earth anchor at each end of the runway to allow for expansion and contraction due to temperature and dynamic loads thereon.

U.S. Pat. No. 4,629,358, Prefabricated Panels for Rapid Runway Repair and Expedient Airfield Surfacing, to Springston et al., Dec. 16, 1986, provided an panel improved over that of the '244 patent in that it was lighter in weight through the introduction of hollow inorganic silica spheres, commercially referred to as "microballoons," in the plastic resin.

Much before the military panels were invented, the use of plastic for landing mats was patented. U.S. Pat. No. 2,653,525, Landing Mat, to McGuire, Sep. 29, 1953, provided an unusually configured mat made of "fibrous reinforced plastic" for use as a runway surface at an airfield.

U.S. Pat. No. 4,746,243, Apparatus and Method for Rapid Repair of Damaged Airfield Runways, to Perry, May 24, 1988, uses the concept of the military runway repair patents with a clamping system and a tapered edge to integrate the mat with existing undamaged runway.

Alternative materials for supporting heavy equipment include a board mat system detailed in U.S. Pat. No. 4,600,337, Board Mat System, to Sarver, Jul. 15, 1986, that uses wooden boards connected in a flexible strip to support heavy loads.

More recent inventions for supporting heavy construction equipment include mats of heavy tubular support designed to be emplaced by the vehicle they support as described in U.S. Pat. No. 6,007,271, Ground Pressure Distribution Mat, to Cole et al., Dec. 28, 1999.

Recent patents for mats that used FRP materials include two with novel means for interlocking the mat panels. U.S. Pat. No. 5,776,582, Load-Bearing Structures with Interlocking Edges, to Needham, Jul. 7, 1998, describes a series of pyramid-shaped elements along opposite edges of a panel designed to interlace with similar elements on an adjoining panel. U.S. Pat. No. 5,888,612, Load-Bearing Structures, to Needham et al., Mar. 30, 1999, describes a honeycombed rectangular panel having an L-shaped stepped down lip running nearly the full distance along a narrow end and only halfway along an adjacent longer side with a straight stepped down lip extending halfway along the side opposite the adjacent longer side but at the other end of that side.

For repair, one type of military mats are emplaced over craters filled with crushed-stone to effect rapid runway repairs. In these applications, the compacted crushed-stone layer carries the load of the aircraft and the FRP mat-serves as a debris cover and wear surface. These military mats are constructed of an array of rigid FRP panels connected via flexible elastomer hinges. The individual panels are typically approximately 9 m×2 m (30 ft×6 ft. and the hinges are approximately 7.5 cm×9 m (3 in×30 ft.). A military mat is comprised of nine of these panels, thus it is approximately 9 m×16 m (30×54 ft) when unfolded. The mats are folded in an accordion (fanfold) fashion for shipment and storage. In use, the mats are unfolded, placed over the repaired pavement, and bolted to undamaged pavement. The material for the mats is a FRP resin composite. Two layers of a woven fiberglass material are embedded in a polyester resin filler to form a mat panel approximately 0.6 cm (0.22 in) thick. The perimeter of the panels is reinforced with an additional narrow strip of FRP material. The upper surface of the mat has a texture defined by the woven roving weave pattern of the FRP material. This effect is obtained by not smoothing over excess resin on the top laminate, thus yielding a non-slippery surface. The folded mat sections are heavy and require heavy equipment and substantial manpower to deploy.

Under a research work unit, several lightweight matting materials were investigated for use to build expedient roads over sands, not just for repair. AT40-MM-005, Advanced Materials for Construction of Contingency Pavement, Waterways Experiment Station (WES), U.S. Army Corps of Engineers, Vicksburg, Miss., 1997. Flat sheets of fiberglass-reinforced mat (1.2 m×3.6 m (4×12 ft), similar to the U.S. Military's Rapid Runway Repair Mat but less bulky, were tested with truck traffic over various types of sand. In order to construct a roadway for test purposes, four smaller sheets of the same mat material were placed under the edges of the larger sheets of mat and each of the larger sheets were bolted to the smaller "joiner" sheets. This mat system showed promise under truck traffic but was difficult as well as labor intensive to construct. Results of this work along with recommendations for improving the mat were reported. Webster, S. and J. Tingle, Expedient Road Construction Over Sands Using Lightweight Mats, WES Technical Report GL-98-10, U.S. Army Corps of Engineers, Vicksburg, Miss., Jun. 1998.

Subsequently, the fiberglass mat design was changed to yield a square 1.8 m (6 ft) on a side after emplacement. A variety of plastic "pop-in-pop-out" connector pins were developed and tested for use with this design. The best plastic pin design was able to withstand 7.6 cm (3.0 in) of rutting in sand-under the mat before failing. Road demonstration tests with the fiberglass mat and plastic "pop-in-pop-out" pins were conducted. Santoni, R. et al., Expedient Road Construction Over Soft Soils, ERDC/GSL TR-0107, U.S. Army Corps of Engineers, Vicksburg, Miss., May 2001. The plastic pins failed in these tests.

What was needed was a simple system for effecting repairs in areas where suitable heavy equipment and materials are not readily available. Also, use of expensive hydraulic tensioners and heavy deadman apparatus was impractical to deploy to areas of varying terrain and limited accessibility. Thus, improvements in connectors for simple lightweight panels led to a preferred embodiment of the present invention. Connector pin assemblies, spacer guides, and mat hole alignment tools were designed and developed for use with the mat panels. A demonstration test road was constructed at the Waterways Experiment Station, Vicksburg, Miss., using an embodiment of this invention further described in detail below.

SUMMARY

A preferred embodiment of the present invention uses lightweight FRP mat panels, preferably in multi-layer laminates, to fabricate a durable surface for applications such as a path, road, equipment or material pad, etc. that generally is intended for temporary use. Each mat panel comprises a flat surface area with L-shaped downward folded sides, or tabs, on two adjoining edges only. The L-shaped tabs provide a bottom ledge for connecting with the non-folded edges of adjacent mat panels. These tabs extend along each of these adjacent edges almost to the end, terminating at a distance from each end that is approximately the width of the tab. This creates a notch at each of the two corners that facilitates fitting adjoining panels.

These panels are connected in the field using specialized connectors that drop-in and are then tightened. Prior to inserting connectors along the L-shaped tabs, a specially fabricated tool is inserted in at least two of the holes in each panel into which the connectors fit in order to properly align the overlapping mats. In a preferred embodiment, the first four (4) threads of a through bolt are coated with a threadlocker such as LOCTITE® 242. Further, a specially fabricated spacer is used to properly set the desired space between the two connector plates during assembly.

A series of holes for connecting adjacent mat panels are contained on the L-shaped tab and adjacent mat panel edges. In a preferred embodiment these holes are generally rectangular with all corners radiused. A typical radius is approximately 1.0 cm (⅜ in).

In a preferred embodiment, the mat panels are sized in any dimension to facilitate manual manipulation and are light weight. For example, a panel designed to cover 3.2 $m^2$ (1.8 m×1.8 m) (36 $ft^2$) (6 ft×6 ft) when installed is fabricated from a fiberglass-reinforced plastic (FRP). It weighs approximately 52 Kg (115 pounds) and can be handled and installed easily by two workers. Because of the extended L-shaped tab, the mat itself is approximately 2.0 m (6 ft–8 in.) on a side.

For installations of a preferred embodiment, the mat panels may be connected by installing the configuration in appropriate patterns to form single-width walkways, single-lane or multi-lane roadways, or variously sized square or rectangular pad configurations. Where load-bearing capacity is not an issue, such as for personnel walkways in remote areas, it may be possible to use lighter mat panels, e.g., those comprising only two FRP laminations.

In a preferred embodiment, the connector pin assembly is comprised of a top and bottom aluminum plate that uses a hex button head or hex head cap screw with internal tooth washer to secure the connection. The aluminum plates may be machined from a high quality aluminum such as 6061-T6. The cap screw slides through the top plate and is attached to the threaded bottom plate. A spacer guide tool is used to pre-set the proper depth of the cap screw so the bottom part of the pin will clear both mat panels being connected and rotate properly during securing of the connection of the mat panels. The threadlocker is applied and provides sufficient strength for the cap screw to rotate the bottom plate 90° in its installed location below the bottom of the lower mat panel, i.e., the area along the L-shaped tab. A cam on the top portion of the bottom plate, i.e., the portion between the two mat panels, locks in the bottom mat panel after the bottom plate rotates 90 degrees. The rotated bottom plate below the bottom mat panel then allows the connector pin to be tightened, thus locking two mat panels together along the L-shaped tab of one of them. During tightening, the threadlocker breaks under medium torque to allow the cap screw to be fully tightened.

During disassembly, the threadlocker again breaks under moderate torque allowing the cap screw to be loosened. As the pin is loosened, the threadlocker retains sufficient locking strength to force the bottom plate to rotate back 90 degrees. After rotating 90 degrees, the cain on the bottom pin plate stops the rotation of the plate to align the bottom plate with the holes in the mat panels for easy removal. The connector pin assembly may then be removed. Alternative methods for temporarily securing the pin include use of a jam nut or a vinyl pad pre-positioned in the threaded hole of the assembly. Further, to permit easy turning of the bottom plate, the bottom of the mat panels may be ribbed to provide a space between the bottom plate and the soil surface.

The connected adjacent mat panels provide a continuous flat mat surface. The mat surface may incorporate a skid resistant texture defined by a woven roving weave pattern of the top ply of fiberglass material, which is not smoothed over by use of excess resin. The cap screw is recessed into the top connector pin plate and the edges of the top plate are rounded to present a low connector pin profile on the surface of the connected mat panels.

Potential uses of the invention include expedient construction and removal of roadways, helicopter pads, aircraft parking aprons, storage pads, tent and shelter flooring, and walkways over loose sands and other unstable terrain. Duckbill type wire rope or other suitable anchors may be used to anchor the perimeter edges where mat sections are used for helicopter pads or vehicle turning and braking shifts the mat.

Advantages of the present invention include:

relatively light weight;

easy to handle by two workers;

durable connections;

easily installed;

easily removed;

damaged panels can be easily replaced during service use;

able to support heavy traffic;

cost effective;

able to be transported using standard means;

reusable;

enables minimal impact in areas of environmental fragility;

adaptable to a variety of applications;

reduced manpower to install and remove;

requires no special support equipment or installation thereof; and standard shipping and handling procedures may be used.

The lightweight mat panels and durable connectors of a preferred embodiment of the present invention are used to construct expedient surfacing to enhance vehicle mobility over unstable terrain. Loose beach, river, desert sands or wet ground conditions frequently are not capable of supporting heavy vehicles such as tractor-trailers, aircraft, or loaded forklifts. Traffic over such unstable soils causes progressive rutting, which limits or stops the vehicle. Traditional pavement construction procedures are usually required to upgrade unstable terrain conditions in order to support heavy traffic loads on a permanent basis. These procedures require stabilizing the unstable soils with large amounts of chemical stabilizers or importing and placing substantial amounts of high-quality construction aggregates to form a base layer of sufficient strength and thickness to support the traffic loads. Traditional pavement construction procedures require substantial amounts of construction equipment, aggregate materials, and construction time. In certain applications, temporary roads must be removed and the terrain restored to its original condition once the roadway has served its intended purpose. Removal incurs additional time and expenses. Consequently, utilization of an expedient surfacing matting material that supports heavy vehicle traffic loads and may be removed quickly and stored for reuse is advantageous.

DETAILED DESCRIPTION

Figure 2:
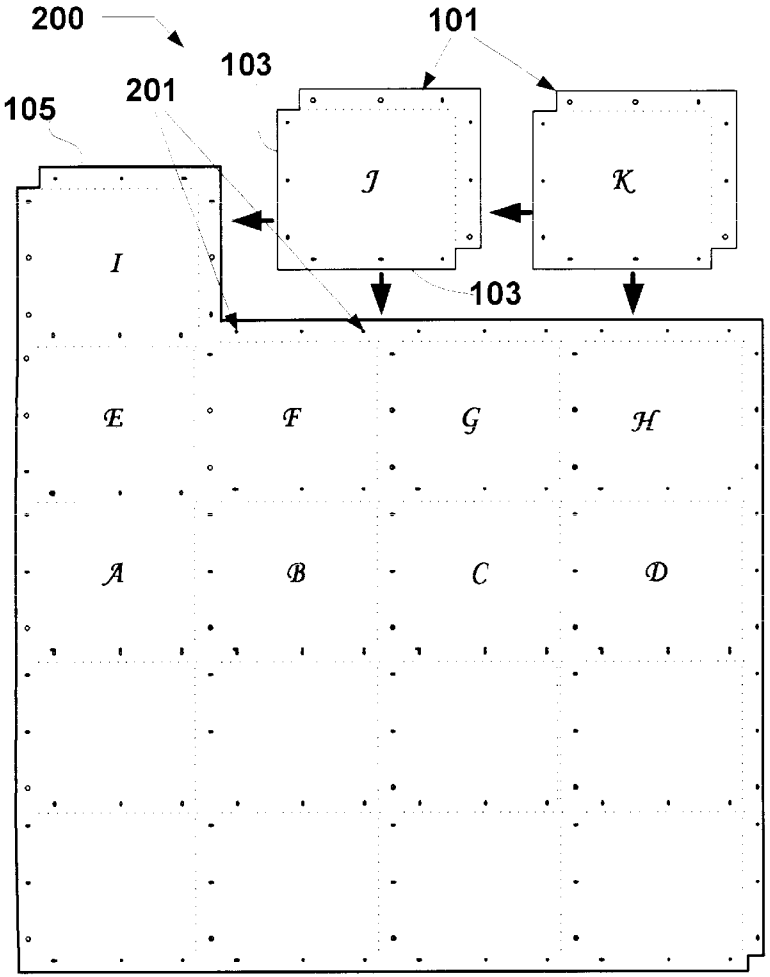
FIG. 2 depicts a typical placement pattern for MP mats to line a two-lane road.

Refer to FIG. 2. A multipurpose mat 200 facilitates mobility of traffic over unstable terrain. The multipurpose mat 200 may be used to facilitate mobility of: humans, animals, robots, wheelchairs, motor vehicles, human-powered vehicles, heavy equipment, military equipment, towed equipment, aircraft, and combinations thereof.

Figure 1:
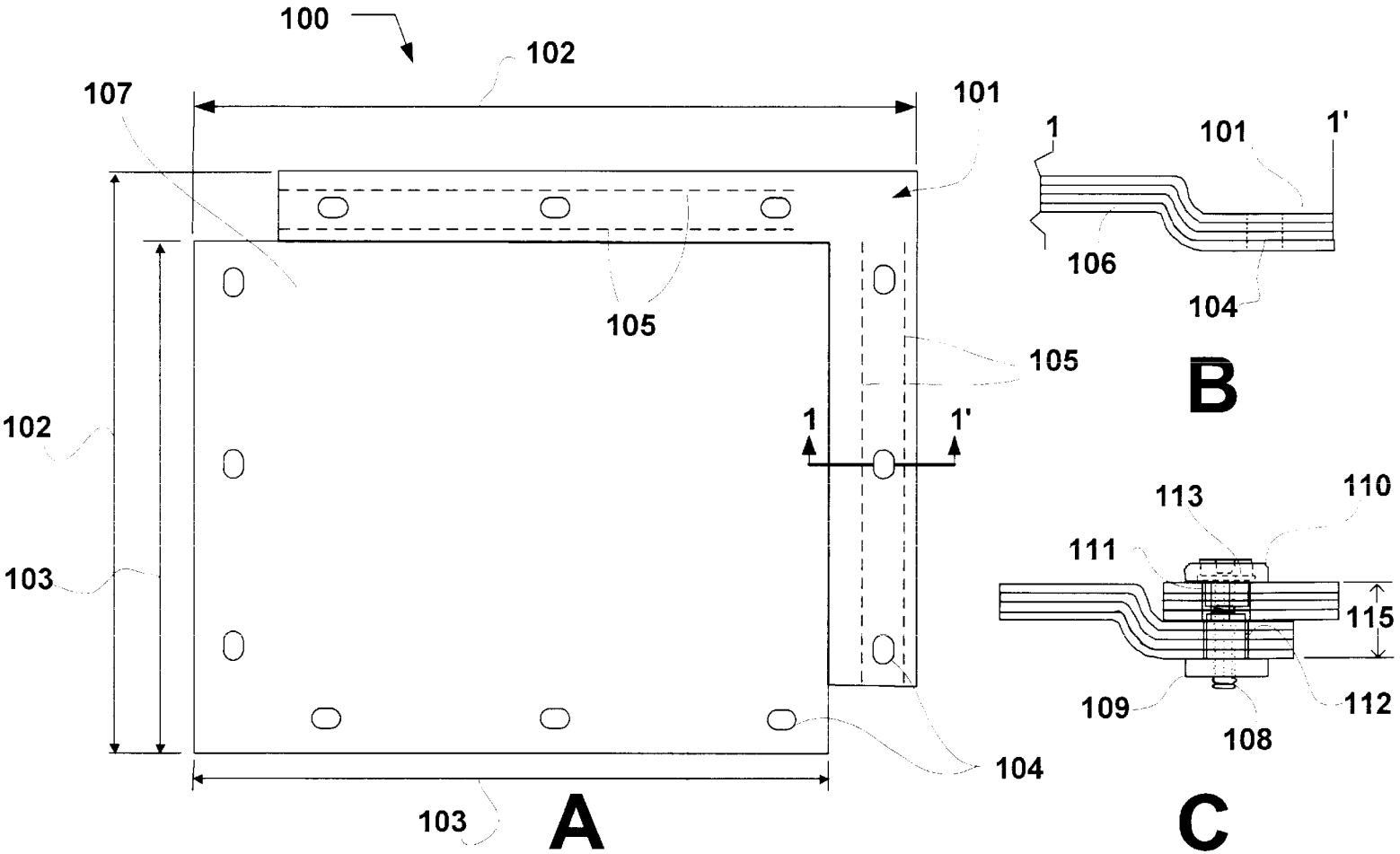
FIG. 1 is a plan view of a Multi-Purpose (MP) mat panel, together with a profile view of the L-shaped tab and a view showing a single connection made with a connector pin assembly.

Refer to FIGS. 1 and 2. The multipurpose mat 200 is constructed of multipurpose panels 100 of multiple laminations 106 suitable for interconnection one to another. This is accomplished via provision of an L-shaped tab 101 integral with each multipurpose panel 100 and positioned along two adjoining edges 103 to effectively increase the width 102 of the panel 100. In this tab 105, as well as in the two remaining edges 103 of the panel 100 are machined precisely located holes 104. The L-shaped tab 101 extends along each of two adjoining sides 103 of the panel 100 to within a distance from a corresponding distal edge of the tab 101 that is approximately equal to or slightly greater than the width of the tab 101. This facilitates fitting the panels together to assure that at each place of overlap the resultant mat 200 will have a surface level with the surface 107 of each panel 100. Also shown as an option to be configured on the bottom of each panel 100 are ribs 105 that may facilitate connection on hard-packed soil.

Figure 6:
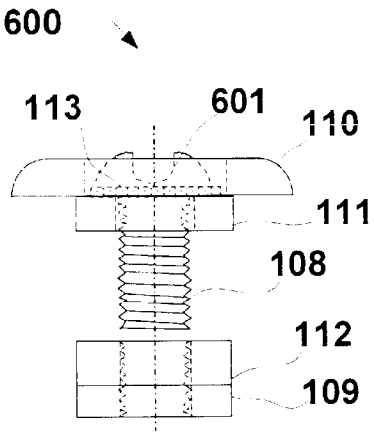
FIG. 6 details a side view of the bottom and top pin connector plates of the connector pin assembly as related to the connection pin.
Figure 9:
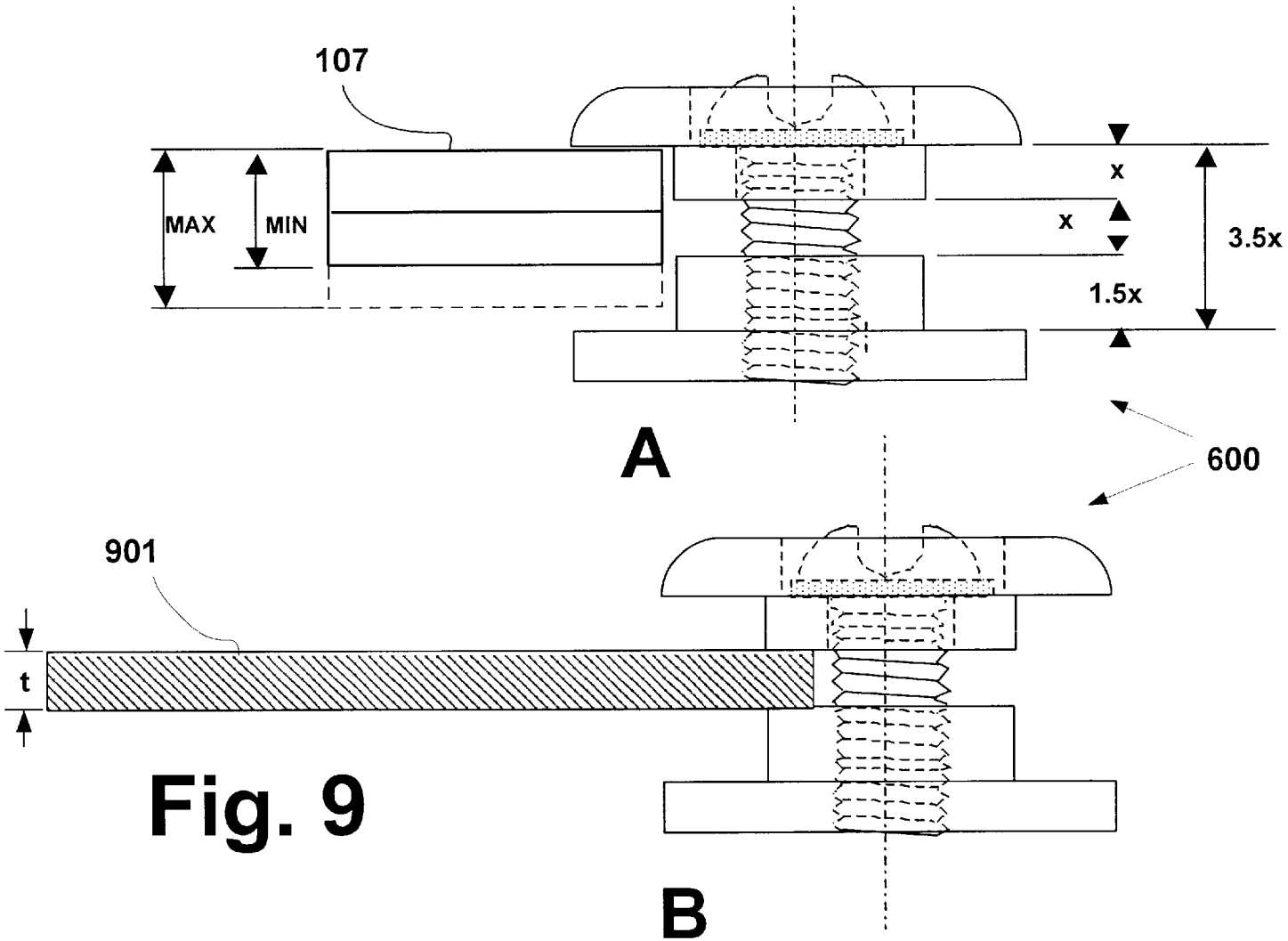
FIG. 9 shows the connector pin assembly prior to installation as well as the insertion of the spacer guide used to set the gap prior to turning the bottom plate 90°.
Figure 10:
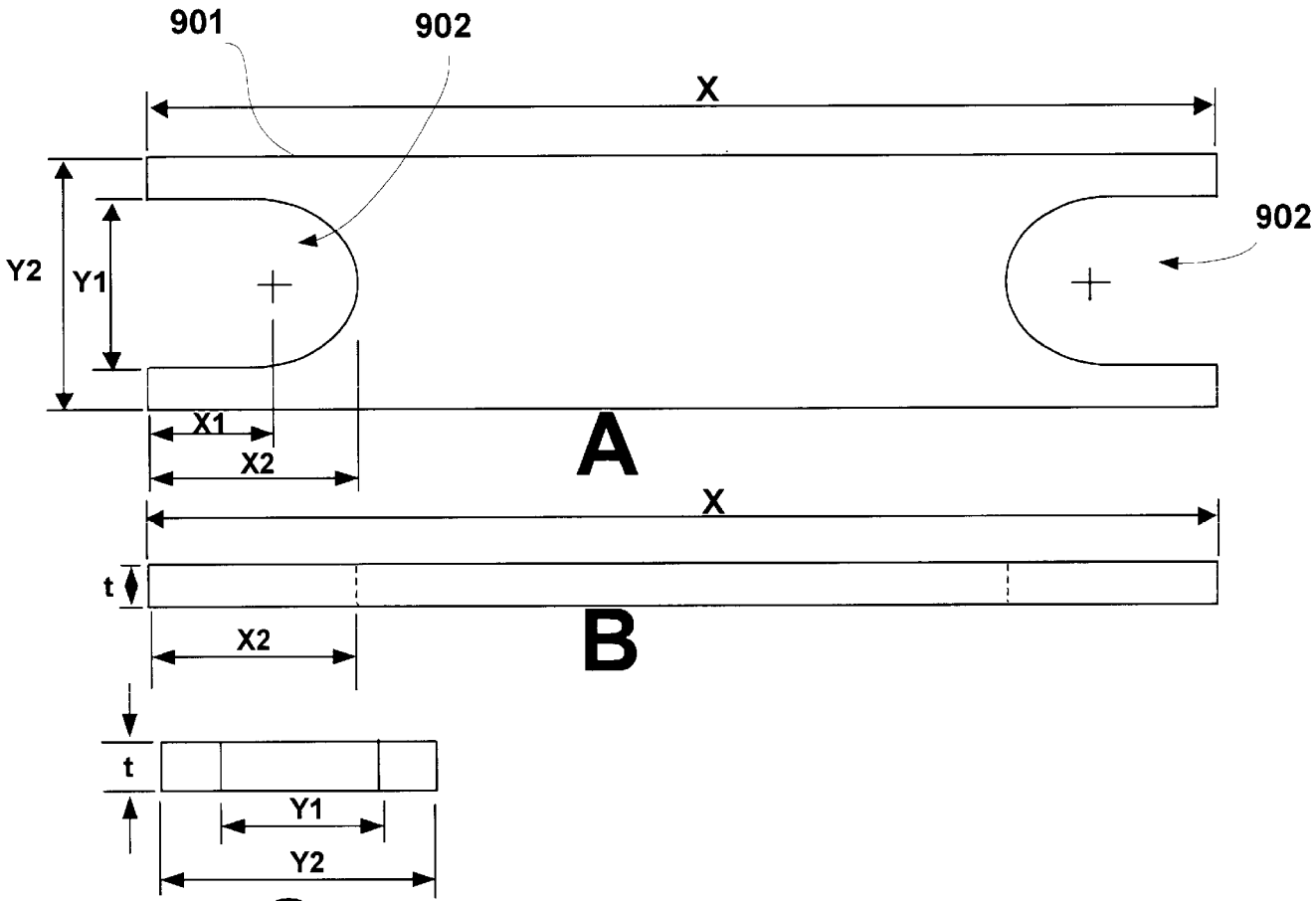
FIG. 10 shows various views of the spacer guide tool used to set the cap screw the proper depth so the bottom part of the pin will clear both mat panels and rotate properly during installation.

Each multipurpose panel 100 may be emplaced manually by two workers. Refer to FIG. 1 and FIG. 6. The durable metal connectors 600 that enable heavy motor vehicles and equipment to traverse the mat 200 may be made of a corrosion resisting metal such as 6061-T6 aluminum. The durable metal connectors 600 are inserted in the precisely located holes 104 in the overlapping edge 103 and tab 101 of adjoining panels 100 to effect the interconnection. Refer to FIGS. 9 and 10. These connectors 600 and a related spacer guide 901 may be used with panels 100 of different thicknesses dependent on the intended application.

The mat 200 when emplaced, provides a surface 107 having the dimensions of a polygon with a thickness much less than any other dimension. It may be used for a road, pathway, storage pad, flooring, landing site, helicopter pad, airfield runway, or similar applications.

In a preferred embodiment, the multipurpose panels 100, when emplaced, individually provide a surface 107 having the dimensions of a square with a thickness much less than any other dimensions.

In a preferred embodiment, the panels 100 are fiberglass-reinforced plastic (FRP) comprising multiple layers or laminations 106 of a woven roving weave pattern of fiberglass material embedded in a polyester resin filler. Generally, each panel 100 is able to be handled by two average workers, thus it should weigh less than about 70 Kg (150 lbs) with a thickness less than about 12.5 mm (0.5 in). Further, to facilitate handling, a maximum single dimension 102 should be less than about 3 m (10 ft). In a preferred embodiment a multipurpose panel 100 of the above construction weighs approximately 52 Kg (115 lbs) with a maximum single dimension 102 of approximately 2 m (6.7 ft) and a thickness approximately 8.9 mm (0.35 in).

Each L-shaped tab 101 is positioned below a top surface 107 of the multipurpose panel 100 to permit an opposing edge 103 of the panel 100, i.e., one that is not tabbed, to overlap the L-shaped tab 101 thus forming overlapping structure 115. This overlapping structure 115 incorporates precisely located holes 104 that are aligned for insertion of the durable connectors 600.

Figure 3:
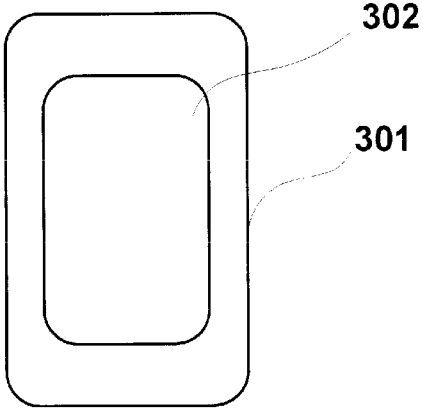
FIG. 3 shows the top and bottom mat panel hole relative sizes, noting that the smaller bottom panel holes are located only on the L-shaped tabs.

Refer to FIG. 3. In one embodiment, the precisely located holes are rectangular 301, 302 with radiused corners, the holes 302 in the tab 101 being slightly smaller, but of the same shape as those holes 301 in the opposing edges 103 of the multipurpose panel 100. The overlap is such that, upon emplacement of the multipurpose panel 100 in the multipurpose mat 200, it provides a surface approximately level with the top surface 107 of each adjoining multipurpose panel 100. Generally, the L-shaped tab 101 is less than about 30 mm (12 in.) in width, with a preferred embodiment having a width of approximately 20 mm (8 in.).

Refer to FIGS. 1, 4, 5 and 6. In a preferred embodiment, the durable connector 600 used with the multipurpose panels 100 is assembled from a top plate 110, 111, a bottom plate 109, 112 incorporating a cam 502 in a topmost portion and having a threaded portion in a bottommost portion 109, and at least a threaded bolt 108.

Figure 5:
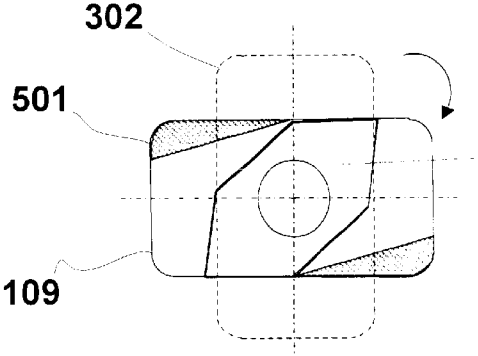
FIG. 5 shows the bottom connector plate of the connector pin assembly before and after bottom connector plate rotation.
Figure 4:
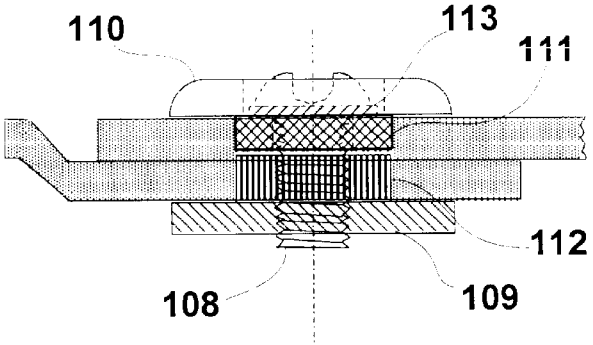
FIG. 4 shows the connector pin assembly as it functions in holding adjacent panels together.

Refer to FIG. 5. The bottommost portion 109 of the bottom plate 109, 112 is rotatable Ho and is locked in a secure position via the cam 502 in the topmost portion of the bottom late 109, 112. The rotation is available through approximately 90° in a plane parallel to the surface 107 of the multipurpose mat 200. By rotating the bottommost part 109 of the bottom plate 109, 112 a firm wide plate as shown rotated in FIG. 5 is provided for tightening the bolt 108 against the overlapped edges of the hole 104 since the bottommost portion 109 of the bottom plate 109, 112 is wider than the width of the rectangular holes 104 in the tab 105, being sized to just fit through the length of the rectangular hole 104 in the L-shaped tab 105.

Refer also to FIG. 6. In a preferred embodiment, the bolt 108 is a hex button-head or hex head cap screw used with an internal toothed washer 113.

Figure 7:
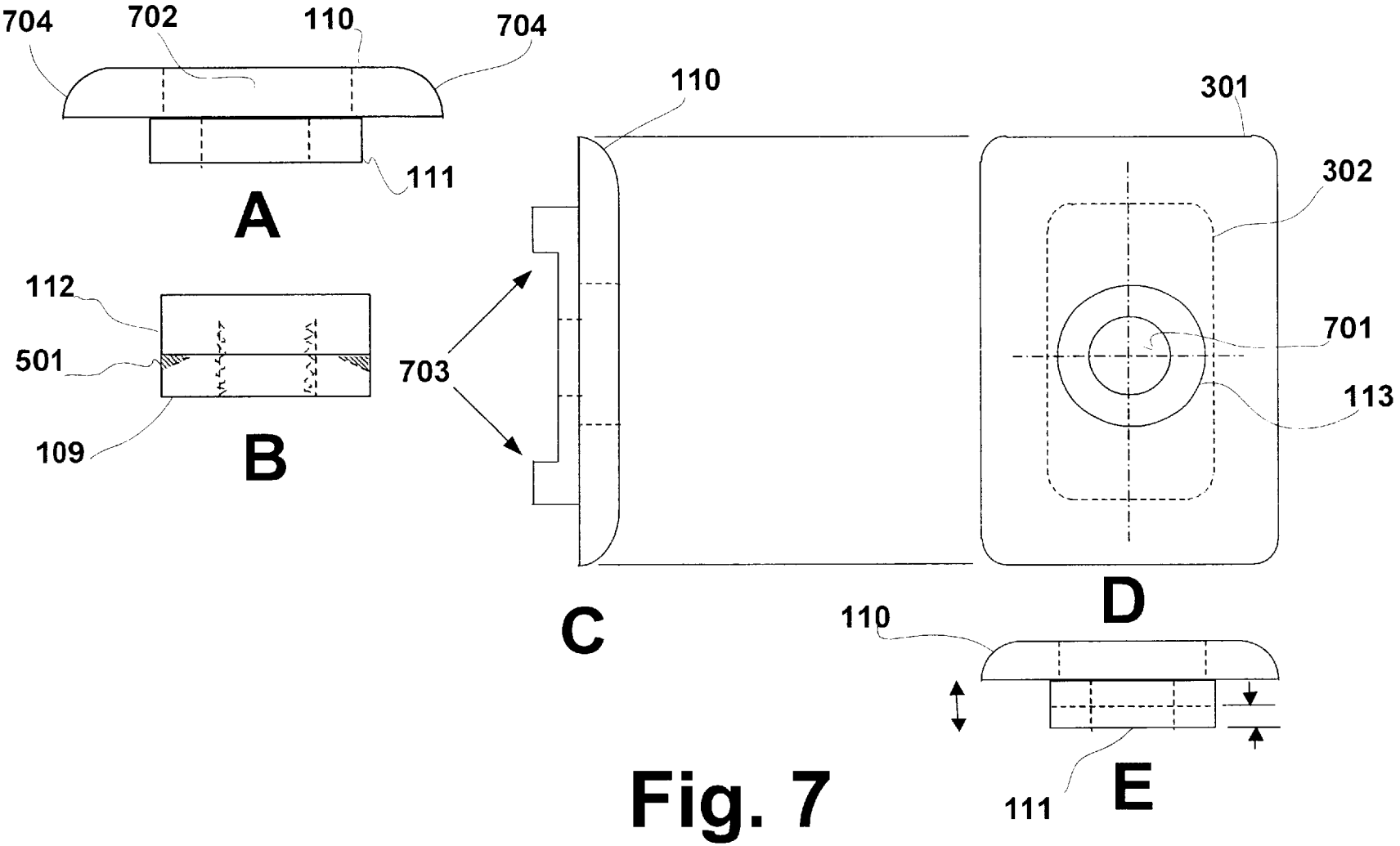
FIG. 7 details an alternate top plate design.

Refer also to FIGS. 5 and 7. In a preferred embodiment, the bottom plate 109, 112 incorporates dimensions that allow free insertion through the precisely located holes 104 in the L-shaped tab 105. It has a bottommost portion 109 having two beveled edges 501, as also shown at B of FIG. 7, such that when the bottom plate 109, 112 is inserted through the overlapping precisely located holes 104 and rotated approximately 90°, the beveled edges 501 easily slide under the bottom of the thus overlapped width of the precisely located hole 104 (as shown in FIG. 5) and provide a resistance plate for tightening the durable connector 600.

Figure 8:
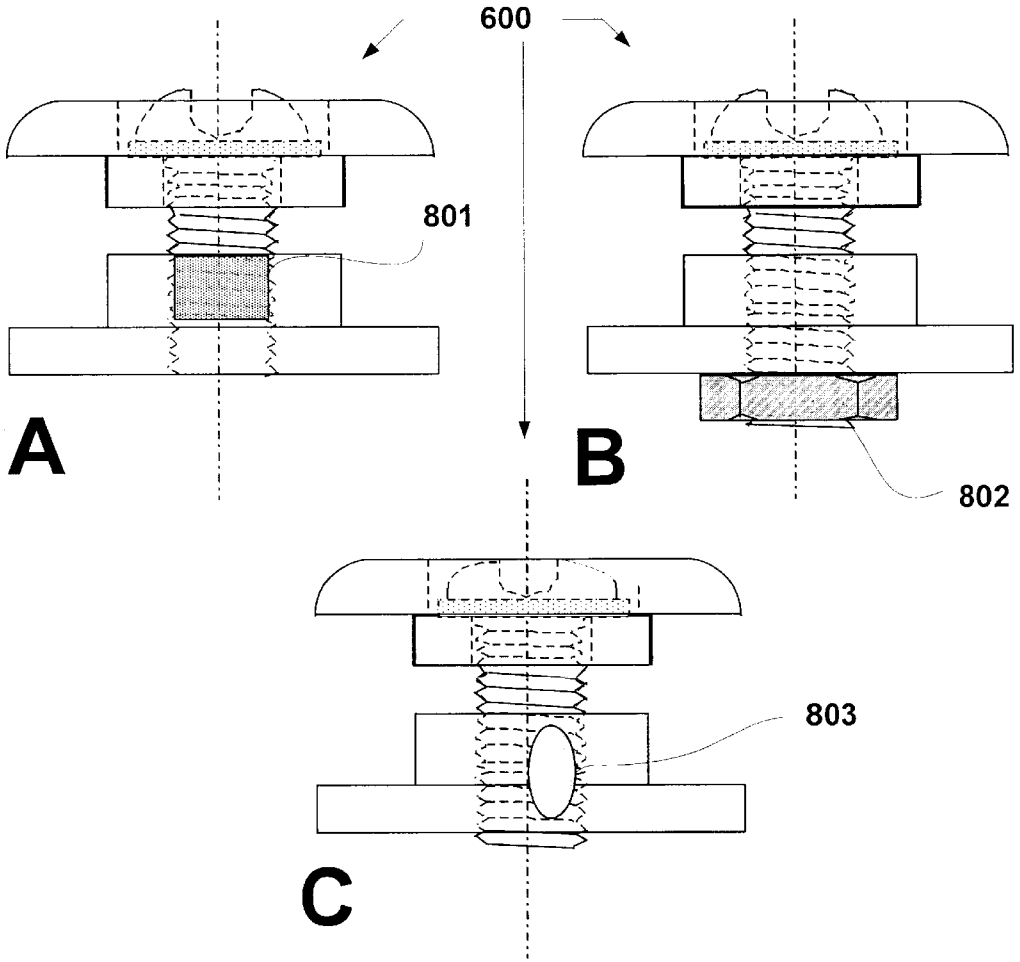
FIG. 8 depicts three alternate configurations for locking the bottom connector plate to the cap screw so it will rotate 90 degrees during mat installation.

Refer to FIG. 8. Alternative configurations for the bottom plate 109, 112 include employing a vinyl patch 803 (at FIG. 8C) in the threaded cavity of the bottom plate 109, 112 to facilitate rotation of the bottom plate 109, 112. Another alternative employs a jam nut 802 (at FIG. 8B) at the bottommost position of the threaded cavity of the bottom plate 109, 112 to facilitate rotation of the bottom plate 109, 112. In a preferred embodiment, a medium strength non-permanent liquid threadlocker 801 (as in FIG. 8A), such as LOCTITE® 242, is applied to some threads of the bolt 108 to facilitate rotation of the bottom plate 109, 112 prior to tightening and subsequently at removal.

Refer to FIGS. 6 and 7. In a preferred embodiment, the top plate 110, 111 incorporates a lower portion 111 dimensioned to recess into the larger sized precisely located holes 104 in the edges 103 of the panel 100, the lower portion 111 having a rectangular channel 703, as shown at C of FIG. 7, machined across its width dimension such that when the bolt 108 is tightened a top portion of the cam 502 nests inside the rectangular channel 703. As shown at E of FIG. 7, this lower portion 111 may be of varying dimension to accommodate different thicknesses of panels 100. This "nesting" prevents the bottom plate 109, 112 from turning during movement of traffic across the multipurpose mat 200, especially in the case of heavy equipment. In a preferred embodiment, top portion 110 of the top plate 110, 111 is sized ;J larger in perimeter than the larger sized precisely located holes 104 in the edges 103 of the multipurpose panel 100. This top portion 110 contains a machined recessed area 702 to house the topmost portion of the bolt 108, i.e., the bolt head 601. A full-depth center hole 701, as shown at D of FIG. 7, is drilled slightly larger than the circumference of the bolt 108 to allow free passage thereof upon insertion through the top plate 110, 111 for threadably attaching to the bottom plate 109, 112. Finally, the top portion 110 has rounded edges 704, as shown at A of FIG. 7, for all its edges to facilitate passage of traffic thereupon.

Figure 11:
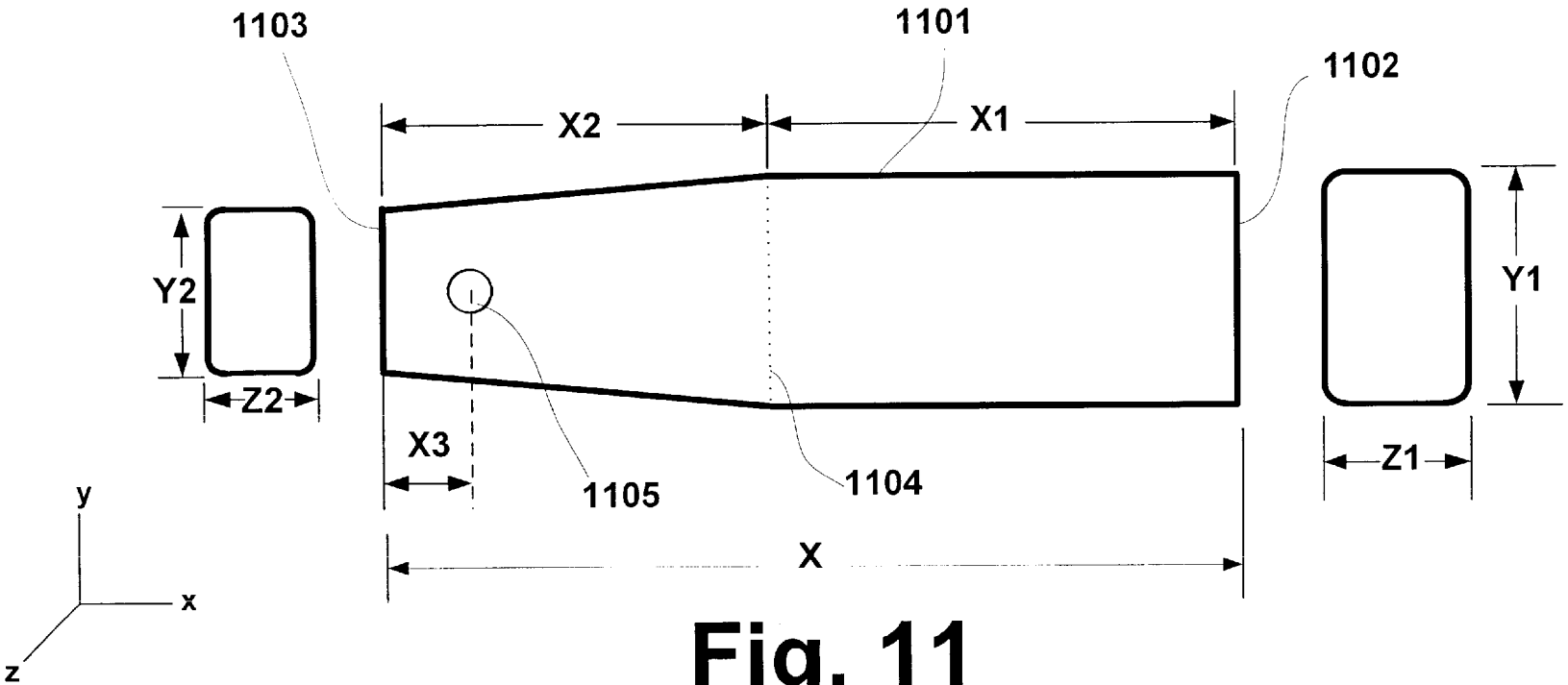
FIG. 11 details various views of the mat hole alignment tool.

Refer to FIGS. 9, 10, and 11. In a preferred embodiment, emplacement of the multipurpose mat 200 is facilitated by two tools; a spacer guide 901 to be used with precisely located holes 104 of a pre-specified type or size of multipurpose panel 100 and an alignment tool 1101 to align overlapping panels 101 prior to interconnection.

Refer to FIGS. 9 and 10. The spacer guide 901 is a flat bar of a thickness, t, predetermined to be correct to adjust the space, x, between the top 110, 111 and bottom plates 109, 112, e.g., in accordance with the restrictions depicted in FIG. 9A, prior to inserting the durable connector 600 in the overlapped precisely located holes 104. The spacer guide 901 is longer than it is wide being of sufficient length, X, to permit ergonomic handling and of sufficient width, Y2, where X>Y2. Y2 is wide enough to allow for the formation of at least one cutout 902 of width Y1, Y1<Y2, with depth at its widest width of X1 and at its radiused width of X2, X1<X2, on at least one of the narrow ends of the spacer guide tool 901. In a preferred embodiment, the cutout 902 is sized to provide a loose fit around one-half of the circumference of the through bolt 108.

Refer to FIG. 11. The alignment tool 1101 facilitates positioning edges 103 of one multipurpose panel 100 over the L-shaped tabs 101 of adjacent multipurpose panels 100. The alignment tool 1101 is a bar having a length, X, longer than either its maximum width, Y1, or maximum thickness, Z1, but having a substantial thickness even at its minimum thickness, Z2. It is shaped in a uniform cross section, Y1×Z1, across its width at a proximal end 1102 and a varying cross section that tapers at a location 1104 part way along its length to a minimum cross section, Y2×Z2, across the width at a distal end 1103. The varying cross section changes as an even taper in width, Y, and thickness, Z, to end in a minimum cross section, Y2×Z2. The taper begins at a pre-specified location 1104 that is closer to the distal end 1103 than the proximal (wide) end 1102. The uniform cross section, Y1×Z1, is sized to fit snugly in the smaller sized precisely located holes 104 in the L-shaped tab 101. Due to the taper, the cross section, Y2×Z2, at the distal end 1103 is smaller than the uniform cross section, Y1×Z1, facilitating fitting an edge 103 of one panel 100 over the alignment tool 1101 inserted in a tab 101 when installing a new panel 100 in the mat 200. The distal end 1103 may have a hole 1105 drilled completely through its thickness, Z, close to the termination of the distal end 1103, e.g., at a distance X3 from said distal end 1103, to facilitate handling and using the alignment tool 1101.

In a preferred embodiment of the present invention, unstable terrain is modified to facilitate traffic mobility using a multipurpose mat 200 built up from multiple multipurpose panels 100 and durable connectors 600. Initially, an existing surface is prepared to insure a smooth and level surface. At any time before, during or after the surface is prepared, durable connectors 600, specifically designed and assembled for use with the specific multipurpose panels 100 to be utilized, are assembled.

To assemble a durable connector 600 of a preferred embodiment of the present invention:

place a washer 113 on a threaded bolt 108;

coat multiple threads of the threaded end of the bolt 108 with a liquid threadlocker as depicted in FIG. 8 at 801, such as medium strength non-permanent LOCTITE® 242 or its equivalent;

insert the threadlocker coated bolt 108, 801 through the top plate 110, 111 of the durable connector 600;

start the coated threaded bolt 108, 801 in the threaded bottom plate 109, 112 of the durable connector 600;

insert a spacer guide tool 901 between the bottommost portion 111 of the top plate 110, 111 and the topmost portion (cam) 502 of the bottom plate 109, 112;

tighten the threadlocker-coated bolt 108, 801 to a snug fit on the spacer guide tool 901;

remove the spacer guide tool 901;

invert the durable connector 600 so that the top plate 110, 111 is resting on a flat surface; and allow the assembled durable connector 600 to remain in this position for a suitable period to cure the threadlocker 801, nominally 24 hours for LOCTITE® 242.

Refer also to FIGS. 2 and 3. A first multipurpose panel 100 is then emplaced on the prepared surface. An alignment tool 1101 is used to form a depression (not separately shown) in the prepared surface by inserting the alignment tool 1101 in the precisely located holes 104 in an L-shaped tab 101 incorporated in the multipurpose panel 100. The depression provides room for the bottommost portion 109 of the bottom plate 109, 112 to turn 90° beneath the tab 101 and between the tab 101 and the soil surface as part of the installation. One end of this tool 1101 fits snugly in the smaller type 302 of the precisely located holes 104 punched in the L-shaped tabs 101 and is used for exact alignment of the overlap of panel edges 103 and L-shaped tabs 101. Additionally, this wide (proximal) end 1102 may be used to form the depression in soft soil or sand, while the narrower (distal) end 1103 may be used for forming the depression in hard-packed soil.

Refer to FIGS. 2 and 3. Place two alignment tools 1101 in two of the precisely located holes 104 as depicted at 201 of FIG. 2. Align an edge 103 of another multipurpose panel 100 with one side of the L-shaped tab 101 of the emplaced multipurpose panel 100 containing the inserted two alignment tools 1101 by positioning the precisely located holes 104 of this edge 103 over the alignment tools 1101 and sliding the panel 100 down upon the alignment tools 1101. This overlaps one side of the L-shaped tab 101 with the edge 103 of the second multipurpose panel 100. Insert a durable connector 600 in one of the overlapping pairs (a smaller hole 302 in the tab 101 and the larger hole 301 in the edge 103) of precisely located holes 104 that do not have an alignment tool 1101 inserted therein and initially rotate the bottom plate 109, 112 of the durable connector 600 approximately 90°. Partially tighten the through bolt 108, 801 no more than one and a half turns. Remove one of the two alignment tools 1101 from the overlapped precisely located holes 104 and insert a durable connector 600 in place of the alignment tool 1101, repeating the rotation and tightening as done for the first durable connector 600. Repeat this process for a second and any subsequent alignment tools 1101 used in emplacing the second multipurpose panel 100 adjacent the first multipurpose panel 100. Repeat for subsequent panels 100 added in a straight line to form a single column of panels 100 as the multipurpose mat 200.

Refer to FIG. 2. For applications requiring a multipurpose mat 200 wider than one multipurpose panel width, repeat the above steps as for a multipurpose panel 100 added to a single column, e.g., panels I, E, and A, et al., for a first panel 100, e.g., J, that may be added to a side of one panel 100, e.g., I, on an end of an existing column of two or more connected panels 100. Since two sides of L-shaped tabs 101, e.g., the tabs 101 of panel 1 and panel F, are now being engaged with a second panel 100, e.g., panel J, added to the second column, e.g., panels B, F, et al., repeat the above steps for alignment and tightening of one edge 103, e.g., the edge 103 of panel J that overlaps the tab 101 of panel F, and then perform the above steps for the second overlapped edge 103, e.g., the edge of panel J that overlaps the tab 101 of panel L Repeat this last "two-edge" process for each multipurpose panel 100, e.g., panel K, emplaced to abut two existing emplaced multipurpose panels 100. Fully tighten any row, e.g., panels A, B, C, D, of emplaced multipurpose panels 100 after a row of multipurpose panels 100 has been installed subsequent to the row to be fully tightened, e.g., panels E, F, G, H, unless a row is the last row to be installed in the multipurpose mat 200.

Refer to FIG. 1. FRP panels 100 of a preferred embodiment of this invention may be fabricated in a manner similar to that of the military mat panels but with different means of connection, i.e., a much more durable connector 600 is used. Further, each of these panels 100 is designed to cover only an approximately 3.2 $m^2$ (36-$ft^2$) area to facilitate manual installation. Typical examples are built up of four (4) plies 106 resulting in an emplaced thickness of approximately 0.9 cm (0.35 in). These panels 100 easily stack on standard pallets and each one requires only two workers to emplace. These individual panels 100, when used with a durable connector 600 of a preferred embodiment of the present invention, result in a stronger mat 200 than that provided with the existing military mat panels. This allows military engineers to address the increased loads expected in deployment of heavy military equipment. Further, these panels 100 do not require a crushed-stone base layer, being connected in rigid fashion with durable connectors 600. They are strong enough to provide vehicle load support for extended periods over unstable terrain conditions. Thicker mats 200 with more plies of FRP and longer durable connectors 600 may be used for very heavy traffic loads, when the mats 200 are placed over very soft terrain, or where both conditions exist.

Although specific types of multipurpose panels, durable connectors, and installation tools are discussed, other similar configurations, including those that may have only some of the constituents used in the above examples, may be suitable for fabricating and installing durable trafficable surfaces and thus fall within the ambit of a preferred embodiment of the present invention as provided in the claims herein.

We claim:

1. A mat, able to be handled manually by only two people, said mat facilitating mobility of traffic over unstable terrain, said mat comprising:

multipurpose panels of a weight less than about 70 Kg (150 lb) and suitable for interconnection one to another via provision of:

an L-shaped tab integral with each said panel and positioned along two adjoining edges, and precisely located rectangular holes, having radiused corners, in said L-shaped tab and said remaining edges of said panels, wherein said L-shaped tab, having a width and a length, extends along each of two adjoining sides of said panel to within a distance from a corresponding distal edge of said panel approximately equal to the width of said L-shaped tab; and durable multi-part metal connectors having a rectangular cross section sized to fit said rectangular holes and configured to lock adjoining said panels together along said L-shaped tabs, comprising:

a bottom plate incorporating at least one threaded cavity in a bottommost portion thereof and a cam in a topmost portion, wherein said bottommost portion of said bottom plate is rotatable and locked in a secure position via said cam, said rotation available through approximately 90° in a plane parallel to said mat surface;

an elongated cylindrically shaped apparatus, threadably attachable to said bottom plate; and a top plate with a cavity centered therein, said top plate having a topmost portion with an outer perimeter larger than said rectangular holes in said remaining edges and at least a bottommost portion, said bottommost portion having a rectangular channel formed across its width dimension such that when said elongated cylindrically shaped apparatus is tightened a top portion of said cam nests inside said rectangular channel, wherein said durable multi-part metal connectors are inserted in said precisely located holes in overlapping structure formed by said edges and said L-shaped tabs of said adjoining panels to effect said interconnection.

2. The mat of claim 1 in which said panels, when emplaced, individually provide a surface having the dimensions of a polygon with a thickness much less than any other dimension.

3. The mat of claim 1 in which said panels, when emplaced, individually provide a surface having the dimensions of a square with a thickness much less than any other dimension.

4. The mat of claim 1 in which said panel is fiberglass-reinforced plastic (FRP) comprising multiple layers of woven roving weave pattern of fiberglass material embedded in a polyester resin filler, said panel having a maximum single dimension of less than about 3 m (10 ft).

5. The mat of claim 4 in which said panel is of a maximum thickness less than about 12.5 mm (0.5 in).

6. The mat of claim 1 in which said panel is fiberglass-reinforced plastic (FRP) comprising multiple layers of woven roving weave pattern of fiberglass material embedded in a polyester resin filler, said panel weighing approximately 52 Kg (115 lbs) with a maximum single dimension of approximately 2 m (6.7 ft).

7. The mat of claim 6 in which said panel is of a maximum thickness approximately 8.9 mm (0.35 in).

8. The mat of claim 1 in which each said L-shaped tab is configured to be below a top surface of said panel to permit an edge of said panel that is not tabbed to overlap said L-shaped tab thus forming said overlapping structure, wherein said overlapping structure incorporates said precisely located holes that are aligned for insertion of said durable connectors, and wherein said overlapping structure, upon emplacement of said panel in said mat, provides a surface approximately level with the top surface of each adjoining said panel.

9. The mat of claim 8 in which said L-shaped tab is less than about 30 mm (12 in.) in width.

10. The mat of claim 8 in which said L-shaped tab is approximately 20 mm (8 in.) in width.

11. The mat of claim 1 in which said radiused corners have a radius of about 0.95 cm (⅜ in).

12. The mat of claim 11 in which said precisely located rectangular holes incorporated in said L-shaped tabs are smaller but of the same shape as said precisely located rectangular holes incorporated in said edges of said panel that overlap said L-shaped tabs, wherein said panel is of a design that permits said rectangular holes incorporated in said L-shaped tab to align with said rectangular holes in said overlapping edges upon juxtaposition of two said panels when forming said mat.

13. The mat of claim 12 in which said bottom plate further employs a vinyl patch in said at least one threaded cavity to facilitate rotation of said bottommost portion of said bottom plate.

14. The mat of claim 1 in which said elongated cylindrically shaped apparatus is selected from the group consisting essentially of: a hex button cap screw with internal tooth washer, a hex head cap screw with internal tooth washer, and combinations thereof.

15. The mat of claim 1 in which said bottom plate incorporates:

dimensions that allow free insertion through said precisely located holes in said L-shaped tab; and two beveled edges on said bottommost portion, such that when said bottom plate is inserted through overlapping said precisely located holes and rotated approximately 90°, said beveled edges easily slide under the bottom of said panel to permit overlap of the width of said precisely located hole and provide a resistance plate for tightening said durable connector.

16. The mat of claim 12 further comprising raised ribs on the bottom side of at least said mm tabs, wherein said raised ribs ease the rotation of said bottom plate in those cases where said mat is emplaced upon a hard surface.

17. The mat of claim 12 in which said bottom plate further employs a jam nut at the bottommost position of said at least one threaded cavity to facilitate rotation of said bottommost portion of said bottom plate.

18. The mat of claim 12 further employing a liquid threadlocker on at least some threads of said apparatus to facilitate rotation of said bottommost portion of said bottom plate.

19. The mat of claim 1 in which said traffic is selected from the group consisting essentially of: humans, animals, robots, wheelchairs, motor vehicles, human-powered vehicles, heavy equipment, military equipment, towed equipment, aircraft, and combinations thereof.

20. The mat of claim 12 in which emplacement of said mat is facilitated by two tools to be used with a pre-specified type of panel, comprising:

a spacer guide comprising a flat bar of a thickness pre-determined to be correct to adjust the space between said top plate and said bottom plate prior to inserting said durable connector in said precisely located holes; and an alignment tool that facilitates positioning one said panel over said L-shaped tab of an adjacent said panel.

21. The mat of claim 20 in which said spacer guide is longer than it is wide, being of sufficient length to permit ergonomic handling and of sufficient width to allow for the formation of a cutout in at least one of the narrow ends of said spacer, said cutout sized to provide a loose fit about one-half of the circumference of said apparatus.

22. The mat of claim 20 in which said alignment tool is a bar having a length longer than either its width or thickness, a first uniform cross section across said width at a proximal end of said length, and a varying cross section that changes across said width at a distal end of said alignment tool, said varying cross section changing as an even taper to a truncated wedge, said taper beginning at a pre-specified point that is closer to said distal end than said proximal end, wherein said uniform cross section is sized to fit snugly in said precisely located holes in said L-shaped tab and said cross section at said distal end is smaller than said uniform cross section, and wherein said distal end may have a hole drilled completely through said thickness near said distal end to facilitate handling and using said alignment tool.

23. A mat, that facilitates mobility of traffic over unstable terrain, comprising:

multipurpose panels suitable for interconnection one to another via provision of:

an L-shaped tab integral with each said panel and positioned along two adjoining edges, and precisely located holes in said L-shaped tab and said remaining edges of said panels, wherein said L-shaped tab, having a width and a length, extends along each of two adjoining sides of said panel to within a distance from a corresponding distal edge of said panel approximately equal to the width of said L-shaped tab, and wherein each said panel may be emplaced manually by two workers; and durable metal connectors comprising:

a bottom plate incorporating a cam in a topmost portion of said bottom plate and having at least one threaded cavity, wherein the bottommost portion of said bottom plate is rotatable and locked in a secure position via said cam, said rotation available through approximately 90° in a plane parallel to said mat surface;

an elongated cylindrically shaped apparatus, threadably attachable to said bottom plate, and a top plate that incorporates:

a lower portion dimensioned to recess into said precisely located holes in said edges of said panel, said lower portion having a rectangular channel machined across its width dimension such that when said apparatus is tightened a top portion of said cam nests inside said rectangular channel, wherein said nesting prevents said bottom plate from turning during movement of said traffic across said mat;

a top portion sized larger in perimeter than said precisely located holes in said edges of said panel;

a machined recessed area to house said topmost portion of said apparatus;

a full-depth center drilled hole slightly larger than the circumference of said apparatus to allow free passage thereof; and rounded edges for all edges of a topmost portion of said top portion, wherein said durable metal connectors are inserted in said precisely located holes in overlapping structure formed by said edges and said L-shaped tabs of said adjoining panels to effect said interconnection.

* * * * *